US006623691B2

(12) United States Patent
Vandeputte et al.

(10) Patent No.: US 6,623,691 B2
(45) Date of Patent: Sep. 23, 2003

(54) ULTRA-LOW CARBON STEEL COMPOSITION, THE PROCESS OF PRODUCTION OF AN ULC BH STEEL PRODUCT AND THE PRODUCT

(75) Inventors: Sven Vandeputte, Ruisbroek (BE); Serge Claessens, Deurne (BE)

(73) Assignee: Sidmar N.V. (BE)

( * ) Notice: Subject to any disclaimer, the term of this patent is extended or adjusted under 35 U.S.C. 154(b) by 0 days.

(21) Appl. No.: 09/747,193

(22) Filed: Dec. 22, 2000

(65) Prior Publication Data

US 2002/0005234 A1 Jan. 17, 2002

(30) Foreign Application Priority Data

Dec. 22, 1999 (EP) ..... 99870278

(51) Int. Cl.[7] ..... C22C 38/12; C22C 38/14; C21D 8/00; C23C 2/06

(52) U.S. Cl. ..... 420/126; 420/127; 148/533; 148/603; 148/320

(58) Field of Search ..... 148/320, 533, 148/603; 420/126, 127, 128

(56) References Cited

FOREIGN PATENT DOCUMENTS

| | | | |
|---|---|---|---|
| EP | 0064552 A1 | | 11/1982 |
| EP | 0816524 A1 | | 1/1998 |
| JP | 05105985 | | 10/1991 |
| JP | 04080323 | | 3/1992 |
| JP | 404080349 A | * | 3/1992 |
| JP | 5059443 | * | 3/1993 |
| JP | 05059443 | | 9/1993 |
| JP | 05263185 | | 10/1993 |
| JP | 07316733 | | 12/1995 |
| JP | 410096064 A | * | 4/1998 |
| JP | 10121192 | | 5/1998 |
| JP | 10280092 | | 10/1998 |

OTHER PUBLICATIONS

Pradhan, R. "Cold–rolled interstitial–free steels: A discussion of some metallurgical topics." Invited Lecture, Bethlehem Steel Research Labs, pp. 165–178. No Publication Date.

* cited by examiner

*Primary Examiner*—Deborah Yee
(74) *Attorney, Agent, or Firm*—Knobbe Martens Olson & Bear LLP

(57) ABSTRACT

The present invention describes an ultra-low carbon bake hardenable galvanized or galvannealed steel product, having a higher yield strength at the temperature of the molten zinc bath while maintaining a low yield strength and excellent bake hardening properties in a skinpassed condition, $BH_0$ being higher than 35 MPa and $BH_2$ higher than 40 MPa (GI) and $BH_0$>20 MPa and $BH_2$>30 MPa (GA), as well as having a superior paint appearance after stamping and painting. The content in the steel composition of the Ti is comprised between 3.42 N and 3.42 N+60 ppm for a fixed nitrogen content (N), and the Nb-content, comprised between 50 ppm and 100 ppm, is fixed so that no substantial precipitation of niobium carbides will occur during the process.

17 Claims, 3 Drawing Sheets

ULTRA-LOW CARBON STEEL COMPOSITION, THE PROCESS OF PRODUCTION OF AN ULC BH STEEL PRODUCT AND THE PRODUCT

FIELD OF THE INVENTION

The present invention is related to an ultra-low carbon steel composition. The present invention is also related to a process of production of an ultra low carbon bake hardenable steel having said composition. The present invention is also related to the end product of said process.

BACKGROUND OF THE INVENTION

In the automobile industry there is a need for hot dip galvanized or galvannealed ultra-low carbon bake hardenable steel (also called ULC BH steel) having excellent dent resistance and very good paint appearance.

Several documents are describing such ULC BH products having either titanium (obtained by the so called Ti-route) or titanium-niobium (obtained by Ti/Nb-route).

More particularly, document EP-A-0064552 describes a method of producing a thin steel sheet having a high baking hardenability and adapted for drawing. The document describes a method comprising the steps of forming a molten steel having a composition containing 0.002–0.015% by weight of C; 0.04–1.5% of Mn; not more than 1.2% of Si; not more than 0.10% of P; 0.001–0.01% of N; 0.01–0.10% of Al, and Nb in an amount within the range (in %) from 2C to 8C+0.02 into a slab, hot rolling the slab, cold rolling the hot rolled sheet, subjecting the cold rolled sheet to a continuous annealing at a uniform temperature between 900° C. and the $Ac_3$ point, and cooling the annealed sheet to a temperature of not higher than 600° C. at an average cooling rate of at least 1° C. per second, preferably at least 10° C. per second.

However drawbacks of this process are the high soaking temperature necessary to dissolve carbides and the fact that a high cooling rate after soaking is necessary to prevent reprecipitation of these carbides. Other disadvantages are the fact that beside the carbon content which must be controlled in a narrow range, also the Nb/C ratio in the steelmaking plant has to be controlled, and finally that, due to the use of Al for binding the N, high coiling temperatures are preferably used in order to prevent deterioration of mechanical and aging properties at the coil ends in case of continuously annealed steel. Higher coiling temperatures are disadvantageous for the pickling of the hot rolled steel before cold rolling.

Document JP-10280092 describes a hot dip galvanized steel sheet having minimal age deterioration in press formability and good baking finish hardenability. This steel has a composition comprising C, Si, Mn, P, S, Al, N, Ti, Nb, Fe and if necessary B, and is providing a metallic structure in which a specific volume percentage of iron carbide exists in the ferrite grain boundary. This metallic structure is formed by subjecting a slab of steel with the above composition to finish rolling at a temperature not lower than the $A_{r3}$ point, performing cold rolling at 65–95%, and then applying continuous hot dip galvanizing and temper rolling to the resultant steel sheet under respectively controlled conditions.

However, iron carbide precipitation in such kind of ULC steels was never detected in the as produced condition due to the very low amounts of carbon and the short times during which these low amounts can precipitate in a continuous annealing process. On the other hand, segregated atomic carbon in grain boundaries has long been physically known.

No $BH_0$ values are mentioned. Also, according to the document, finishing rolling must be performed not lower than the $A_{r3}$ point which becomes more difficult in case of alloying with P and Si. No minimum Nb addition is specified in the abstract. Ti is added as a function of N and S-contents.

Document JP-5059443 describes a process of fabrication of a steel sheet having good formability which comprises the steps of adding Ti and Nb in relation with the C, N, S contents, while controlling carbonitride in an ultra-low carbon steel having a specific composition where Ti and Nb are combinedly added. This steel is hot-rolled at a finishing temperature (T2) higher than or equal to $(A_{r3}-100)$° C., coiled at a temperature (T3) between 500 and 750° C., and cold-rolled with a reduction of area higher or equal to 60%. Subsequently, this steel sheet is subjected to recrystallization annealing at 700–850° C. by means of a continuous hot-dip galvanizing line having an in-line annealing furnace, and galvanizing is done in the course of cooling. By this method, a hot dip galvanized cold rolled steel sheet having required baking hardenability (BH characteristic) and formability can be obtained.

In particular, JP-5059443 requires that the Nb-content comply with the following condition: $Nb \geqq 93/12[C-0.0015]$, wherein the Nb and C-contents are expressed in weight %. However, Nb addition as a function of carbon is an extra difficulty to realize in an industrial steelmaking plant.

Document EP-A-0816524 describes a cold-rolled steel sheet or a zinc or zinc alloy layer coated steel sheet containing 0.0010 to 0.01% of C and having a steel composition containing one or two kinds of 0.005 to 0.08% of Nb and 0.01 to 0.07% of Ti in the ranges given by specific relations. However, Nb and Ti are added specifically to have a minimum amount of fine NbC and/or TiC not less than 5 ppm, in order to get higher n-values. Moreover, said document gives explicitly a range for $BH_2$ between 10 and 35 MPa, without mentioning $BH_0$ values Document JP05263185 describes a steel grade where the BH is in fact obtained by annealing in the two-phase ($\alpha+\gamma$) region followed by cooling which leads to a final acicular ferritic structure with a high dislocation density. A high Mn-content is needed in order to decrease the transformation temperatures. In order to have a good texture in the presence of a high Mn-content, free carbon during the recrystallization has to be avoided and is therefore being precipitated by Ti and Nb, before annealing is started. In the two-phase region some of these carbides are then dissolved providing free carbon. However, even with the large Mn-additions, the Ac1 temperatures are still high and annealing in the high temperature two-phase region is technologically a high cost-increasing factor.

Document JP04080323 describes a Ti-ULC BH steel which may contain 10–40 ppm Nb, without impairing the aimed properties. The claimed analysis also specifies a maximum N-content of 20 pppm, which is a high restriction for the steelmaking plant. However, prior research and industrial trial results have shown that with such Ti-ULC BH grades with a low <40 ppm Nb addition, low yield strength occurs at the zinc bath temperature, which has a negative effect on the surface appearance of such steel sheets. The bad surface appearance of steel sheet obtained through the Ti-route is a consequence of small deformations, which are caused in the zinc bath and its immediate surroundings, by the high tensile stress in the zinc bath section and by the guiding rolls, which position the sheet between the air knives. In fact, the sum of the tensile stress generated by both the tensile forces applied to control the band behavior as well as the stress induced in the outer surface layers by bending of the sheet on the rolls in the zinc bath and by the imbricator rolls, may not exceed the yield strength of the material at the elevated temperatures of the zinc bath and its surroundings. The appearance is indeed increasingly bad at higher line tensile stresses and higher out of line imbricator roll positioning.

After stamping and before painting, this effect can be visualized on a Marciniak sample by way of transversal lines, even on sheets which have undergone the skinpass treatment and have been labeled as suitable for exposed parts. After the final painting of the surface, it exhibits an orangepeel-like appearance with high waviness. Due to this phenomenon, it can be expected that steels with a low yield strength (less than 220–240 MPa at room temperature) are most likely to suffer from this, which has indeed been verified in laboratory tests.

SUMMARY OF THE INVENTION

The present invention is related to an ultra-low carbon steel composition intended to be treated in a process comprising the steps from hot-rolling until hot-dip galvanizing or galvannealing and skinpass, said composition being characterized by the content of titanium, which is comprised between 3.42N and 3.42N+60 ppm for a fixed nitrogen content (N) and by the niobium content, which is comprised between 50 and 100 ppm, these contents being fixed so that no substantial precipitation of niobium carbides will occur during said process. More specifically, the present invention relates to an ultra-low carbon steel composition with the above characteristics, wherein no more than 2 ppm of carbon is bound in the form of Nb-carbides during said process The composition of such an ultra-low carbon bake hardenable steel product is preferably characterized by

- a C-content comprised between 15 ppm and 45 ppm,
- a N-content comprised between 0 and 100 ppm, preferably between 0 and 40 ppm,
- an Al-content comprised between 0 and 1000 ppm,
- a P-content comprised between 0 and 800 ppm,
- a B-content comprised between 0 and 20 ppm,
- a Si-content comprised between 0 and 4000 ppm,
- a Mn-content comprised between 500 and 7000 ppm,
- a S-content comprised between 0 and 200 ppm, preferably comprised between 0 and 100 ppm,
- the balance being substantially Fe and incidental impurities.

For a steel composition intended for galvanizing, the preferable carbon-content is comprised between 20 ppm and 25 ppm.

For a steel composition intended for galvannealing, the preferable carbon-content is comprised between 25 ppm and 30 ppm.

The present invention further relates to a process for producing an ultra-low carbon bake hardenable, galvanized or galvannealed steel product comprising the steps of,

- preparing a composition wherein the titanium content is comprised between 3.42N and 3.42N+60 ppm, and the niobium content is comprised between 50 ppm and 100 ppm, these contents being fixed so that no substantial precipitation of niobium carbides will occur during the process,
- if necessary, reheating said slab at a temperature (T1) higher than 1000° C.,
- performing a hot rolling having a finishing temperature (T2) higher than $A_{r3}$−100° C. and preferably higher than $A_{r3}$−50° C.,
- performing a coiling at a temperature comprised between 500° C. and 750° C.,
- performing a cold rolling in order to obtain a reduction higher than 60%,
- annealing up to a maximum soaking temperature comprised between 780° C. and 880° C.,
- performing a galvanizing or galvannealing step
- performing a skinpass reduction comprised between 0.4% and 2%.

Reheating of the slab can be unnecessary if the casting is followed in line by the hot rolling facilities.

During the process, no substantial formation of TiC and NbC occurs, which is why a lower soaking temperature can be applied. Also, the use of Ti to bind the N is advantageous in that it solves the problem of high coiling temperatures. A maximum of 20 ppm N as described in one of the earlier mentioned documents is not necessary for the present invention which removes a difficulty for realization in the steelmaking plant.

Furthermore, the Nb-content is independent of the C-content, which solves the problem of the fixed Nb/C relation.

In order to achieve an increase of the yield strength at the zinc bath temperature, the necessary grain boundary modifications induced by the Nb are becoming effective at minimum 50 ppm Nb added. The presence of Nb ensures that the conventional yield strength $Re_{0.2}$ at the zinc bath temperature (typically 460° C.), of the steel sheet obtained by the process of the present invention, is a least 130 MPa. At 460° C., microplasticity, for the steel obtained by the process of the present invention, starts at a stress level equal or above 70 MPa, which is a higher value than that of steels without Nb. Meanwhile, the yield strength at room temperature does not differ from the values obtained on these compared steels (having no Nb), which typically range from 160 MPa to 350 MPa after processing and temper rolling. This solves the problem of plastic deformation during processing in the zinc bath Bake hardening values obtained on the final product are as follows:

Guaranteed $BH_0$ en $BH_2$ measured for a thickness lower than 1 mm, in the as skinpassed condition (measured according to the standard SEW094):

GI (galvanized):
$BH_o$>35 MPa, and >40 MPa at C>20 ppm
$BH_2$>40 MPa

GA (galvannealed):
$BH_0$>20 MPa
$BH_2$>30 MPa

The final product also exhibits an excellent dent resistance and a superior surface quality after stamping and painting, as a consequence of the absence of said plastic deformations occurring around the zinc bath section.

DETAILED DESCRIPTION OF THE PREFERRED EMBODIMENTS

Figure 1:
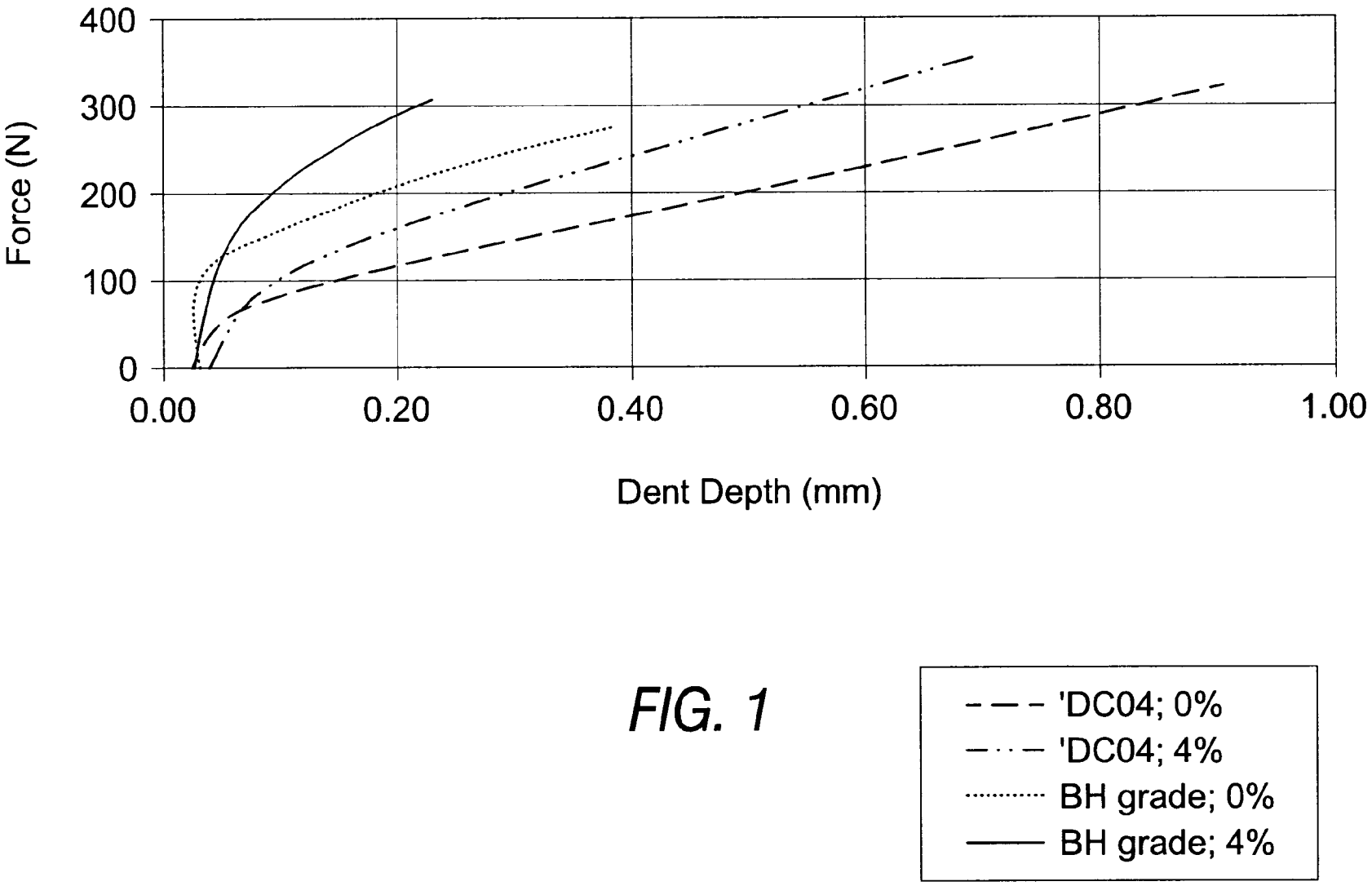
FIG. 1 shows the dent resistance of a steel according to the present invention.

According to the present invention an ultra-low carbon bake hardenable galvanized or galvannealed steel product is proposed, having a composition comprising:

C: between 15 ppm and 45 ppm, preferably between 20 ppm and 30 ppm: the C-content is important to acquire a balance between bake hardening and aging characteristics of the steel. All of the carbon is supposed to remain in a 'free' condition, as opposed to bound in carbide form, to accommodate the paint baking. The minimum C-content guarantees the bake hardening, the maximum reduces the risk of stretcher strains.

N: maximum 100 ppm. The maximum is imposed because the N-content is related to the Ti-content. The N-content is preferably lower than 40 ppm because of a better formability due to a lower amount of precipitates.

Ti: between 3.42 times the N-content and 3.42XN+60 ppm. A minimum Ti-content is needed to bind all of the N, the maximum allowable level is needed to avoid formation of $Ti_xC_yN_z$. In this respect, preferably 3.42N+30 ppm should be used as maximum level when the upper C-levels of the above C-range are used. The use of Ti to bind the N is an improvement compared to existing steels in which Al is used for this purpose. The use of Al for binding N in case of continuously annealed steel requires higher coiling temperatures in order to prevent deterioration of mechanical and ageing properties at the coil ends. These higher coiling temperatures are negative for the pickling. Also, the presence of unbound N is particularly detrimental for the resistance of the bake hardening quality to aging. The use of Ti ensures the absence of free N more than does the use of Al. Accordingly, Ti is not added as function of S. No TiS or $Ti_4C_2S_2$ are observed in the steel of the present invention.

Nb: between 50 ppm and 100 ppm. In order to get an increase of the yield strength at the zinc bath temperature (typically 460° C.), grain boundary modifications induced by the Nb are needed. These modifications are becoming effective at minimum 50 ppm Nb added. The minimum is required to ensure the finer grain size. The maximum level should not be exceeded in order to avoid the formation of NbC. It should be noted that the Nb addition is in a fixed range, independent of C and carbonitride formation does not have to be controlled since no significant amounts of NbC or TiC are formed in the preferential analysis.

Al: maximum 1000 ppm. Used for de-oxidizing. The maximum level is introduced to avoid inclusions.

P: maximum 800 ppm. P is added for strengthening purposes, but the amount must be controlled in order to avoid lowering the galvannealing speed.

B: maximum 20 ppm. The presence of B is not a necessity, but it can be added to improve the Cold Working Embrittlement properties. The maximum is introduced to avoid the formation of BN, which may leave some Ti unbound, which in turns can lead to a loss of unbound C.

Si: maximum 4000 ppm. Si is also added for strengthening purposes, which improves the texture in the presence of P and Mn and which opposes the low temperature aging. The maximum is introduced in order to avoid a deterioration of the surface treatability.

Mn: between 500 and 7000 ppm, and added for strengthening purposes. It also bounds S as MnS. The maximum is introduced to improve texture and drawability.

S: maximum 200 ppm, preferably lower than 100 ppm. It should be noted that a minimum S-content is not necessary here.

the balance being substantially Fe and incidental impurities,

Also according to the present invention, said steel product is produced by a method comprising the steps of:

preparing a slab having a composition such as defined here above, if necessary, reheating said slab at a temperature T1, higher than 1000° C., hot rolling mill finishing at a temperature T2, higher than $A_{r3}$−100° C., preferably higher than $A_{r3}$−50° C. (There is no need in the present invention to perform hot rolling strictly above Ar3), Hot rolling mill coiling at a temperature between 500° C. and 750° C., Cold rolling and obtaining a reduction, higher than 60%, annealing up to a maximum soaking temperature comprised between 780° C. and 880° C., performing a galvanizing or galvannealing step performing a skinpass reduction comprised between 0.4% and 2%

An averaging treatment can be applied in the course of the annealing line after the soaking or after the coating step, but this results in a slight loss of bake hardening. Preferably, an averaging should not be applied.

The addition of P, Mn and Si leads to yield strengths between 160 MPa and 350 MPa at room temperature. Research relative to the present invention has indicated that P, Mn and Si have no significant influence on the bake hardening of ULC BH steels, in so far as their amounts are lying within the proposed boundaries.

FIG. 1 proves the excellent dent resistance of the steel, by comparing the ULC BH 220 GA (standard SEW094) variety to the variety DC04 (standard EN 10130) having good drawing properties and a yield strength of 165 MPa. The data in the graph are based on a Marciniak panel with a thickness normalized to 0.711 mm and baked after 0 or 4% biaxial deformation. It is apparent from FIG. 1 that the necessary force to obtain a permanent dent of 0.1 mm has doubled.

Because of the insufficient appearance of the surface of steels obtained by the Ti-ULC route for their use in exposed applications, a small amount of Nb was added, in order to acquire a finer grain size and increase the grain boundary strength at the temperature of the zinc bath. There is no need to form NbC and subsequently dissolve it during recrystallization annealing (as is described in EP A 0064552). In the present invention, there is no substantial precipitation of niobium carbides, for example on the castings 1 and 2 of the preferred embodiment, whose composition is described in table 1. On these castings, a quantitative TEM survey revealed that a maximum of 0.2 ppm of carbon was bound in the form of $Nb_{0.7}Ti_{0.3}C(N)$ in a coil of GI-steel, or $Nb_{0.4}Ti_{0.6}C$, in a coil of GA-steel. These results clearly prove the fact that the small Nb-content does not lead to substantial precipitation of carbides.

Earlier high temperature tensile tests have revealed that the tensions which cause the initial plastic deformation of Ti-ULC 180 BH steel during the tensile test at 460° C. are of the same order of magnitude as the tensions imposed on the Ti-ULC 180 BH steel during its passing through the zinc bath. The idea arose therefore, to use the Nb-addition as a means of increasing the yield strength around this temperature of 460° C.

Figure 2A:
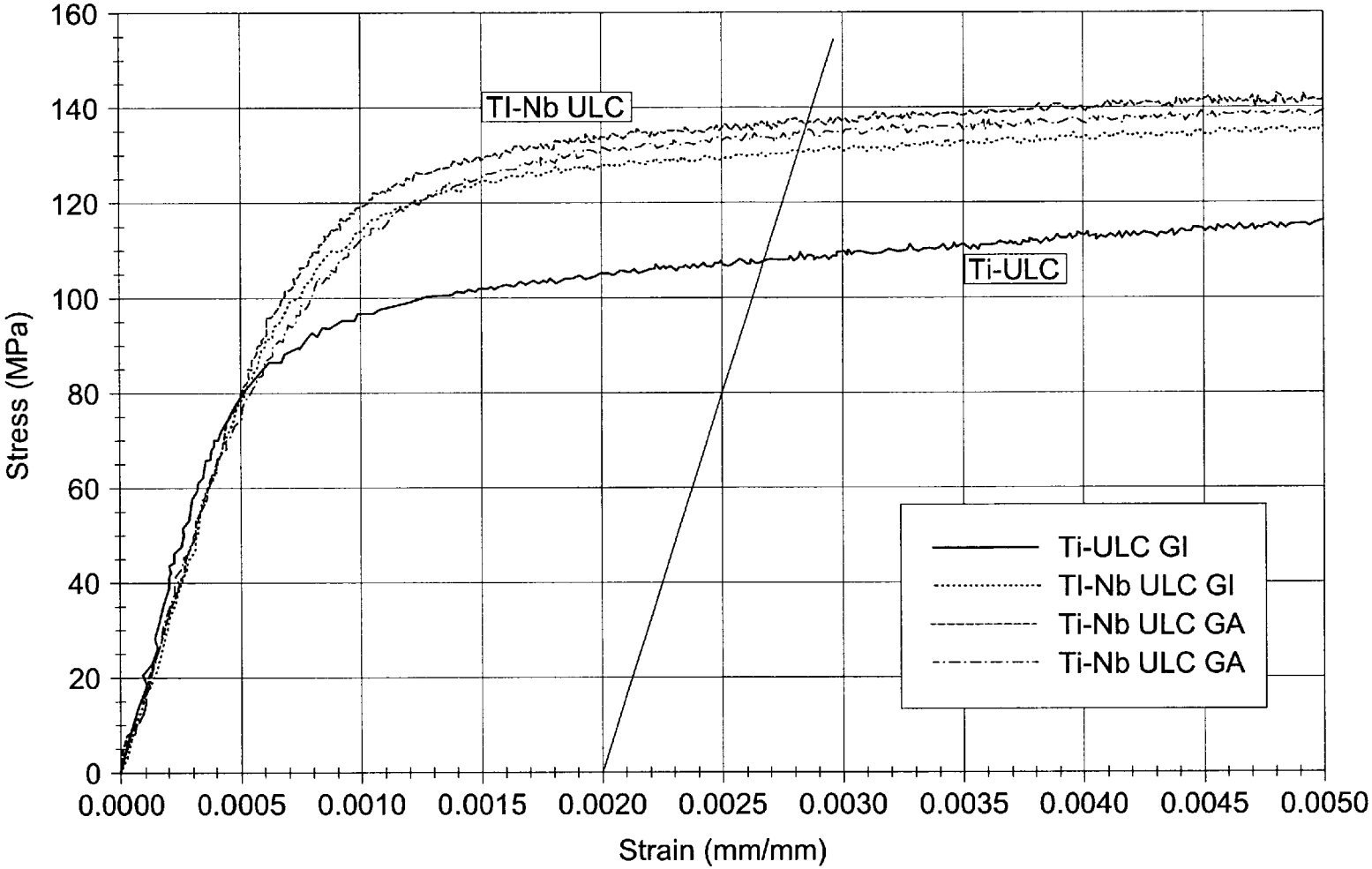
FIG. 2*a* shows hot tensile test results at a temperature of 460° C.
Figure 2B:
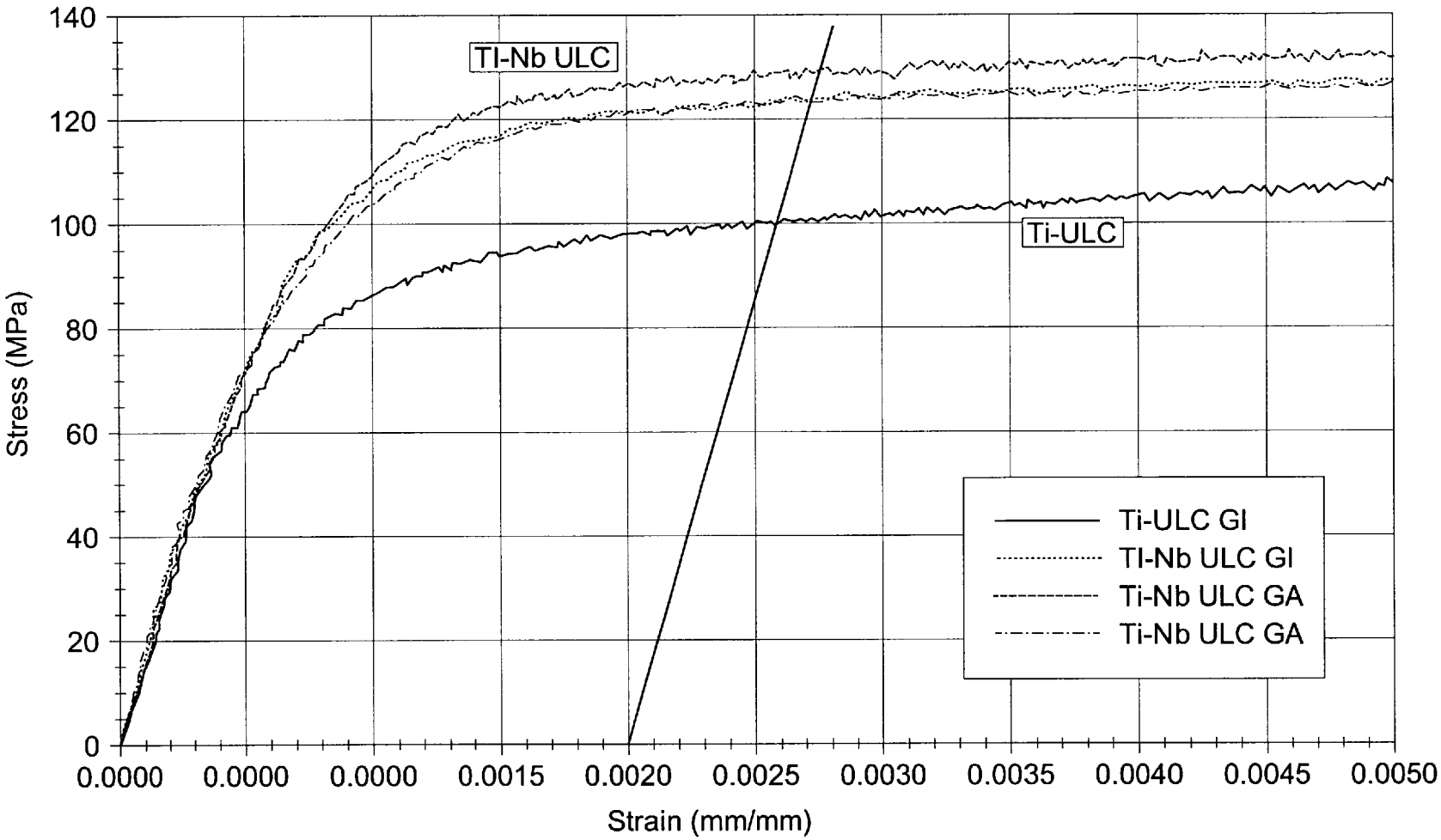
FIG. 2*b* shows hot tensile test results at a temperature of 480° C.

FIGS. 2*a* and 2*b* show the results of tensile tests performed at 460° C.–480° C. on Ti-ULC (state of the art reference quality) and on Ti-Nb ULC 180 BH, a steel according to the present invention. Measurements are performed according to the standard EN 10002.

The plastic deformation of the Ti-ULC steel is started at a lower tension and the conventional yield strength $Re_{0.2}$ is lower by 20–30 MPa. These results prove the ability of a small addition of Nb to increase the yield strength at the zinc bath temperature, while maintaining the same yield strength at room temperature. FIGS. 2*a* and 2*b* equally show that microplastic deformation at 460–480° C. occurred starting from 70–90 MPa for the steel according to the invention, as opposed to ±50 MPa in the case of the reference quality Ti-ULC steel. The start of microplasticity is defined as the first deviation from the linear part of the stress strain diagram. In some tensile tests the microplasticity start of the Ti-ULC quality was found to be as low as 40 MPa at 460–480 degrees. This proves that the Nb does provide the desired effect. Apparently, the sum of the tensile stresses mentioned above is in practical industrial hot dip galvanizing/galvannealing coating lines frequently situated above the microplasticity level of the steel of comparison but below the microplasticity level of the steel of invention As expected, the Nb-addition also led to a finer grain size: the average grain diameter was 13 $\mu$m, as opposed to 18 $\mu$m for the Ti-ULC steel, both steels being subjected to the same soaking temperature (±830° C.) while the Ti-Nb ULC underwent a lower cold reduction: 69% as opposed to 75% for the Ti-ULC steel. Due to the Nb-addition, the paint appearance of the 180 BH steel was evaluated as very good.

The following bake hardening values for the final product obtained by the process of production described here above are as follows:

Guaranteed $BH_0$ en $BH_2$ measured for a thickness lower than 1 mm (measured according to the standard SEW094):

GI: $BH_o$>35 MPa, and >40 MPa at C>20 ppm $BH_2$>40 MPa

GA: $BH_0$>20 MPa $BH_2$>30 MPa

Table 1 shows the composition of two castings of ULC BH (Ti-Nb) steel products according to the present invention.

The processing steps are:

Slab reheating at T1>1250° C.

Hot rolling mill finishing at T2, between 910° C. and 940° C.

Hot rolling mill coiling at T3: between 700° C. and 750° C.

Cold reduction: 69%

Hot dip galvanizing line soaking at temperature between 829° C. and 880° C.

Skinpass: 1–1.32%

Table 2 shows the obtained mechanical properties of the Ti-Nb ULC BH steel grades.

Table 3 gives an overview of the bake hardening and paint appearance properties of the (Ti-Nb) ULC BH steel according to the present invention, compared to the corresponding properties of a reference Ti-ULC BH steel. It should be stressed that the paint appearance is judged on samples acquired on the industrial line, and not in the laboratory.

TABLE 1 composition (ppm) of the Ti-Nb steel products according to the present invention.

| Cast | C | N | S | Ti | Nb | P | Mn | Si | Al | B | V |
|---|---|---|---|---|---|---|---|---|---|---|---|
| 1 | 25–36 | 22 | 74 | 80 | 80 | 140 | 1580 | 1230 | 350 | 1 | 20 |
| 2 | 17–27 | 26 | 49 | 90 | 70 | 180 | 1570 | 1180 | 360 | 1 | 20 |

TABLE 2

Mechanical properties of the Ti-Nb ULC BH steel before stamping and painting (transversal, aged 1 h at 100° C., thickness 0.75 mm).

| Cast N° | Grade | $R_e$ MPa | $R_m$ MPa | A80 % | YPE % | r90 | n90 | $BH_0$ MPa | $BH_2$ MPa |
|---|---|---|---|---|---|---|---|---|---|
| 1 | GI | 220–242 | 331–346 | 35–41 | 0–1.0 | 1.82–2.32 | 0.173–0.186 | 42–60 | 42–52 |
| 1 | GA | 227–252 | 328–345 | 31–46 | 0–1.0 | 1.67–1.90 | 0.159–0.190 | 26–45 | 30–50 |
| 2 | GI | 202–217 | 322–332 | 35–42 | 0–0.5 | 1.86–2.37 | 0.181–0.201 | 37–47 | 45–48 |
| 2 | GA | 214–229 | 318–330 | 32–37 | 0 | 1.63–1.93 | 0.164–0.188 | 21–40 | 32–38 |

TABLE 3

Summary: results of Bake Hardening derived from tensile test results according to SEW094 and paint appearance of stamped and painted samples, based on painted Marciniak samples.

| | | Grade GI (galvanized) | | |
|---|---|---|---|---|
| Line | | Reference steel: Ti-ULC C: 12–18 ppm | Reference steel: Ti-ULC C: 41–47 ppm | Invention steel: Ti—Nb ULC C: 17–26 ppm |
| Line 1 | $BH_0$ | 5 | | |
| | $BH_2$ | 26 | | |
| | Paint appearance | Bad | | |
| Line 2 | $BH_0$ | 20 | | 37–47 |
| | $BH_2$ | 34 | | 45–48 |
| | Paint | Bad | | Good |

TABLE 3-continued

| | | |
|---|---|---|
| | Summary: results of Bake Hardening derived from tensile test results according to SEW094 and paint appearance of stamped and painted samples, based on painted Marciniak samples. | |
| | appearance | |
| Line 3 | $BH_0$ | 18–42 |
| | $BH_2$ | 43–60 |
| | Paint appearance | Bad |

| | | GA (galvannealed) | | |
|---|---|---|---|---|
| Line | | Reference steel: Ti-ULC C: 12–18 ppm; | Reference steel: Ti-ULC C: 41–47 ppm | Invention steel: Ti—Nb ULC C: 22–27 ppm |
| Line 1 | $BH_0$ | 2 | | |
| | $BH_2$ | 19 | | |
| | Paint appearance | Bad | | |
| Line 2 | $BH_0$ | 1 | | 21–40 |
| | $BH_2$ | 22 | | 32–38 |
| | Paint appearance | Bad | | Good |

Line 1 with averaging
Line 2 without averaging
Line 3 without averaging

What is claimed is:

1. A steel composition, comprising:

a nitrogen content N between about 0 and 40 ppm, a carbon content C between about 20 ppm and 30 ppm;

a sulfur content between about 0 and 100 ppm;

a titanium content between about 3.42N and 3.42N+30 ppm; and a niobium content between about 50 ppm and 100 ppm, wherein the niobium and carbon contents, when expressed in weight % are no related by Nb≧93/12[C−0.0015].

2. The composition of claim 1, wherein precipitation of niobium carbides is limited to about 2 ppm of bound carbon during processing of said steel composition by hot rolling, galvanizing and/or galvannealing, and skinpass.

3. The composition of claim 1, comprising:

an aluminum content between about 0 and 1000 ppm;

a phosphorous content between about 0 and 800 ppm;

a boron content between about 0 and 20 ppm;

a silicon content between about 0 and 4000 ppm; and a manganese content between about 500 ppm and 7000 ppm.

4. A process for producing an ultra-low carbon bake hardenable, galvanized or galvannealed steel product comprising:

forming a steel slab having a composition comprising a nitrogen content N between about 0 and 40 ppm, a carbon content C between about 20 ppm and 30 ppm, a sulfur content between about 0 and 100 ppm, a titanium content between about 3.42N and 3.42N+30 ppm, and a niobium content between about 50 ppm and 100 ppm, wherein the niobium and carbon contents, when expressed in weight % are not related by Nb≧93/12[C−0.0015];

hot rolling said slab having a finishing temperature at least Ar3−100° C.;

coiling said slab at a temperature between about 500° C. and 750° C.;

cold rolling said slab to obtain a reduction higher than about 60%;

annealing said slab to a soaking temperature between about 780° C. and 880° C.;

galvanizing or galvannealing said slab; and performing a skinpass reduction between about 0.4% and 2%.

5. The process of claim 4, further comprising reheating said slab at a temperature of at least about 1000° C. before hot rolling said slab.

6. An ultra-low carbon bake hardenable galvanized steel product comprising a nitrogen content N between about 0 and 40 ppm, a carbon content C between about 20 ppm and 30 ppm, a sulfur content between about 0 and 100 ppm, a titanium content between about 3.42N and 3.42N+30 ppm, and a niobium content between about 50 ppm and 100 ppm, wherein the niobium and carbon contents, when expressed in weight % are not related by Nb≧93/12[C−0.0015], wherein the yield strength Re0.2 of said product at 460° C. is at least 130 MPa, wherein the start of microplasticity at 460° C. occurs above a stress level of 70 MPa, said product having a final yield strength Re0.2 at room temperature between about 160 MPa and 350 MPa.

7. The product of claim 6, wherein the baked hardening $BH_0$ is at least 35 MPa and $BH_2$ is at least 40 MPa for a thickness up to about 1 mm in a skinpassed condition.

8. An ultra-low carbon bake hardenable galvannealed steel product comprising a nitrogen content N between about 0 and 40 ppm, a carbon content C between about 20 ppm and 30 ppm, a sulfur content between about 0 and 100 ppm, a titanium content between about 3.42N and 3.42N+30 ppm, and a niobium content between about 50 ppm and 100 ppm, wherein the niobium and carbon contents when expressed in weight % are not related by Nb≧93/12[C−0.0015], wherein the yield strength Re0.2 of said product at 460° C. is at least 130 MPa, wherein the start of microplasticity at 460° C. occurs above a stress level of 70 MPa, said product having a final yield strength Re0.2 at room temperature between about 160 MPa and 350 MPa.

9. The product of claim 8, wherein the baked hardening $BH_0$ of said slab is at least 20 MPa and $BH_2$ is at least 30 MPa for a thickness up to 1 mm in a skinpassed condition.

10. A method of forming a finished steel product comprising:

forming a steel slab having a composition comprising a nitrogen content N between about 0 and 40 ppm, a carbon content C between about 20 ppm and 30 ppm, a sulfur content between about 0 and 100 ppm, a titanium content between about 3.42N and 3.42N+30 ppm, and a niobium content between about 50 ppm and 100 ppm, wherein the niobium and carbon contents when expressed in weight %, are not related by Nb≧93/12[C−0.0015], processing said steel slab so as to form said finished part, and painting at least exposed portions of said finished part, wherein said niobium content enhances paint appearance of said finished steel product.

11. The method of claim 10, wherein said processing comprises hot rolling, galvanizing or galvannealing, and skinpass.

12. A product obtained by the process of claim 4.

13. The product of claim 12, wherein said product comprises:

a nitrogen content N between about 0 and 40 ppm;

a carbon content C between about 20 ppm and 30 ppm;

a sulfur content between about 0 and 100 ppm;

a titanium content between about 3.42N and 3.42N+30 ppm; and a niobium content between about 50 ppm and 100 ppm, wherein the niobium and carbon contents, when expressed in weight %, are not related by Nb≧93/12 [C−0.0015].

14. The product claim 13, wherein said product comprises:

an aluminum content between about 0 and 1000 ppm;

a phosphorous content between about 0 and 800 ppm;

a boron content between about 0 and 20 ppm;

a silicon content between about 0 and 4000 ppm; and a manganese content between about 500 ppm and 7000 ppm.

15. A product obtained by the process of claim 10.

16. The product of claim 15, wherein said product comprises:

a nitrogen content N between about 0 and 40 ppm;

a carbon content C between about 20 ppm and 30 ppm;

a sulfur content between about 0 and 100 ppm;

a titanium content between about 3.42N and 3.42N+30 ppm; and a niobium content between about 50 ppm and 100 ppm, wherein the niobium and carbon contents, when expressed in weight %, are not related by Nb≧93/12 [C−0.0015].

17. The product of claim 16, wherein said product comprises:

an aluminum content between about 0 and 1000 ppm;

a phosphorous content between about 0 and 800 ppm;

a boron content between about 0 and 20 ppm;

a silicon content between about 0 and 4000 ppm; and a manganese content between about 500 ppm and 7000 ppm.

* * * * *

UNITED STATES PATENT AND TRADEMARK OFFICE

CERTIFICATE OF CORRECTION

PATENT NO. : 6,623,691 B2
DATED : September 23, 2003
INVENTOR(S) : Vandeputte et al.

It is certified that error appears in the above-identified patent and that said Letters Patent is hereby corrected as shown below:

Title page,
Item [54], Title, please replace "PRODUCT AND THE PRODUCT" with -- PRODUCT AND THE PRODUCT OBTAINED --.

Column 9,
Line 38, please replace "no" with -- not --.

Column 11,
Line 7, please replace "product claim" with -- product of claim --.

Signed and Sealed this

Twenty-fifth Day of May, 2004

JON W. DUDAS
*Acting Director of the United States Patent and Trademark Office*